United States Patent [19]

Kirk, Jr. et al.

[11] 4,149,508

[45] Apr. 17, 1979

[54] ELECTRONIC IGNITION SYSTEM EXHIBITING EFFICIENT ENERGY USAGE

[76] Inventors: Donald Kirk, Jr., 1965 Arrowhead Dr. N E., St. Petersburg, Fla. 33703; Kirk M. Charles, 1625 Talbot Ave., Jacksonville, Fla. 32205

[21] Appl. No.: 819,541

[22] Filed: Jul. 27, 1977

[51] Int. Cl.[2] ..... F02P 5/06; H05B 41/02

[52] U.S. Cl. ..... 123/148 CB; 123/148 E; 315/209 CD

[58] Field of Search ..... 123/148 E, 117 R, 148 CB, 123/148 CA; 315/209 T, 209 CD

[56] References Cited

U.S. PATENT DOCUMENTS

| | | | |
|---|---|---|---|
| 3,489,129 | 1/1970 | Issler et al. | 123/148 CB |
| 3,599,616 | 8/1971 | Oishi et al. | 123/148 CB |
| 3,620,201 | 11/1971 | Warren et al. | 123/148 CB |
| 3,718,125 | 2/1973 | Posey | 123/148 CB |
| 3,780,343 | 12/1973 | Stonham | 123/148 CB |
| 3,839,659 | 10/1974 | Bruijning et al. | 123/148 CB |
| 3,898,971 | 8/1975 | Lafevre | 123/148 CB |
| 3,926,165 | 12/1975 | Merrick | 123/148 E |
| 3,945,362 | 3/1976 | Neuman et al. | 315/209 T |

*Primary Examiner*—Charles J. Myhre
*Assistant Examiner*—P. S. Lall
*Attorney, Agent, or Firm*—Hopgood, Calimafde, Kalil, Blaustein & Lieberman

[57] ABSTRACT

An automotive ignition system utilized multiple sparks for each cylinder ignition to ensure complete burning of the fuel mixture therein. To this end, a plurality of control signals are produced each time the engine breaker points or other timing apparatus signals that a chamber is conditioned for combustion. Successive control signals during each combustion cycle build up and collapse a magnetic field in the primary winding of the ignition coil to thereby generate the requisite multiple sparking. The resultant complete burning of the fuel mixture in each cylinder results in increased gas mileage, reduced air pollution, and improved and continued high level engine performance, notwithstanding degradation in ignition system elements.

16 Claims, 7 Drawing Figures

ELECTRONIC IGNITION SYSTEM EXHIBITING EFFICIENT ENERGY USAGE

DISCLOSURE OF THE INVENTION

1. Field of the Invention

This invention relates to automotive ignition systems and, more particularly, to an improved automotive ignition system utilizing multiple ignition sparks.

2. Description of the Prior Art

Automotive ignition systems are typically the weakest link in the proper performance of the modern internal combustion gasoline engine. They are frequently the major cause of poor performance, poor fuel mileage and increased exhaust emmissions. Notwithstanding the critical role played by the ignition system, it is imperative that the system work properly in the hostile environment of moisture, dirt, heat and vibration found in the automotive engine. In addition, the ignition system must function well in the presence of the partial failure of other components such as spark plugs, connectors and high voltage cable.

The prior art ignition system used almost exclusively, until fairly recently, is the well known Kettering system. The Kettering system includes a low voltage primary circuit which contains a storage battery, the primary of the ignition coil and engine breaker points. The breaker points are opened and closed by an engine driven cam. When the points are closed, current flows from the battery, through the primary of the coil, through the points and back to the battery via the engine ground connection. The current flow through the primary winding induces a magnetic field in the core of the coil. When the breaker points open, the current which has been flowing through the points is allowed to flow into a capacitor connected in parallel with the points. As the capacitor charges, the magnetic field in the coil collapses, inducing a high voltage pulse into the secondary of the coil. This high voltage pulse is then applied to the spark plugs in the engine via a high voltage distributor circuit which is driven in synchronism with the breaker points by the same shaft which drives the cam.

The Kettering system, although widely used, suffers from several disadvantages. The primary disadvantages are breaker point wear and the slow rise time of the high voltage pulse applied to the spark plugs. In an attempt to overcome these disadvantages, the prior art devised two other ignition systems. The first of these is the transistor ignition system which simply utilizes a transistor rather than the breaker points to switch the current in the primary coil circuit. The breaker points turn the power transistor on and off. Breaker point wear is thus reduced since the interrupted current flow in the coil primary is effected by the transistor thereby eliminating arcing across the breaker points.

The second ignition system is the capacitor discharge ignition system. This system places a capacitor in series with the primary of the ignition coil which is alternatively charged and discharged to produce the creation and the collapse of a magnetic field in the primary of the ignition coil. The use of such a capacitor allows the storage of greater energy for each spark and thus decreases the rise time of the pulse applied to the spark plugs.

Notwithstanding the attempted prior art improvements in ignition systems, a major problem still remains. This problem is the incomplete burning in the combustion chamber which frequently results with these prior art systems. Incomplete burning results because the fuel mixture in the combustion chamber is frequently too lean or too rich at the time of the single spark generated by the prior art systems. With such a mixture, ignition frequently does not occur at all or ignition occurs very slowly and is not completed before the piston is moved from its optimum firing position. Incomplete burning results in increased fuel consumption, added air pollution and reduced engine performance. With the prior art systems, this problem can only be overcome by refining the timing constraints such that firing always occurs at the proper time for optimum burning. Such accurate timing is difficult if not impossible to achieve and maintain.

It is therefore an object of this invention to provide an improved ignition system which solves the problem of incomplete burning without requiring an increase in timing accuracy.

It is another object of this invention to provide such an improved system which costs no more than the prior art systems currently in use.

It is a further object of this invention to provide such an improved system which is more reliable than the prior art alternatives currently in use.

An additional prior art system which attempted to solve the problem of incomplete burning was the ignition system used in the "Model T" Ford. In this system, a separate ignition coil was provided for each of the four cylinders. A timing switch rotated by the engine connected power in turn to each ignition coil. Battery current flowed through the primary of the ignition coil and also through a set of breaker points arranged in a self interruption electrical configuration similar to a doorbell buzzer. When the current reached a certain value, the points opened and the subsequent collapse of the magnetic field in the coil generated the desired spark. The breaker points then closed when the current flow ceased. This process continued as long as voltage was continuously applied to a particular coil assembly, thereby generating a series of sparks for each cylinder in turn. The multiple sparks applied to each cylinder tended to ensure complete burning. This system, however, only worked well at low engine speeds and the timing was very inaccurate due to the primitive nature of the breaker points. At high engine speeds common in modern engines, this system would be inoperative.

It is, therefore, a further object of this invention to provide complete burning without sacrificing timing accuracy.

It is another object of this invention to provide a system which provides complete burning even at the high engine speeds common in modern engines.

SUMMARY OF THE INVENTION

In accordance with the invention, accurate timing information is derived from the opening and closing of the breaker points (or from comparable timing apparatus) in response to the rotation of a cam shaft driven by the automobile engine.

It is a feature of the invention that a predetermined number of successive control signals are generated each time the breaker points are opened.

It is another feature of the invention that a magnetic field is respectively built up and collapsed in the primary winding of the ignition coil in response to successive control signals during each chamber firing cycle.

It is a further feature of the invention that multiple control signals are generated during the interval in which the breaker points are open and signal generation is terminated during the interval in which the breaker points are closed.

The repetitive build-up and collapse of a magnetic field in the primary winding of the ignition coil occurs in response to the multiple control signals produced while the breaker points are open. This action generates a plurality of sparks for each cylinder ignition rather than the single spark ignition utilized in the prior art ignition systems. The generation of a plurality of ignition sparks ensures complete burning for each cylinder ignition, thereby overcoming the disadvantages of increased fuel consumption, added air pollution and reduced engine performance which are inherent in prior art ignition systems.

The foregoing and other objects and features of this invention will be more fully understood from the following description of illustrative embodiments thereof in conjunction with the accompanying drawings.

DETAILED DESCRIPTION

Automobile engines are operated by igniting a premixed charge of fuel vapor and air in the engine's combustion chamber. The charge is ignited by passing a high voltage electric current between the two electrodes of the spark plug in the combustion chamber. When a spark of sufficient energy jumps the gap between the electrodes a self propagating flame is produced which spreads rapidly throughout the charge. The ignition system in FIG. 1 known as the Kettering system, is the basic prior art system utilized to produce the charge which ignites the mixture in the combustion chamber.

Figure 1:
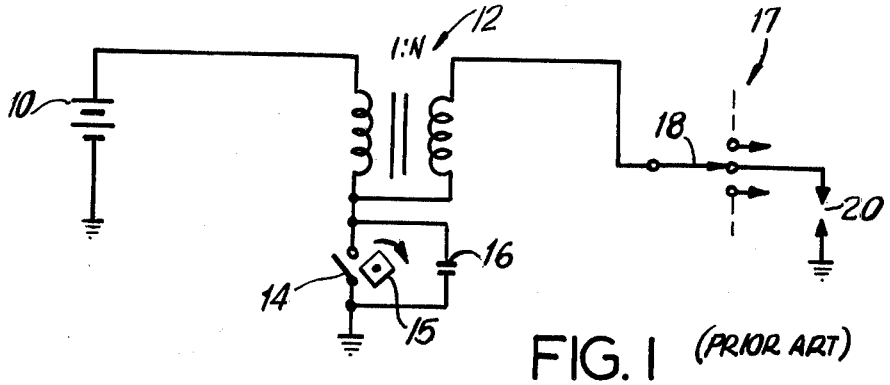
FIG. 1 (PRIOR ART)
FIGS. 1, 2 and 3 illustrate prior art automotive ignition systems.

Battery 10 in FIG. 1 supplies power for the low voltage primary circuit which includes the primary winding of ignition coil 12, capacitor 16, and breaker points 14. Cam 15 rotates in the direction indicated to open and close breaker points 14. When the breaker points are closed current flows from battery 10 through the primary winding of coil 12 through breaker points 14 and back to the battery through the engine ground connection. Coil 12 is wound around a soft iron core. The current in the primary winding induces a magnetic field in and around this core. When the breaker points are opened by the rotation of cam 15 the current which has been passing through the points now flows into capacitor 16. As capacitor 16 charges the magnetic field rapidly collapses in the primary winding of coil 12. This rapid collapse of the magnetic field in the primary winding induces a high voltage (on the order of twenty thousand volts) in the secondary winding of coil 12. The high voltage induced in the secondary is distributed to the spark plugs 20 in proper sequence by distributor 18 and its contacts 17. Distributor 18 is driven by the same shaft that drives cam 15. Only one spark plug 20 is shown, but it is understood that one spark plug would be utilized for each engine chamber. Capacitor 16 is utilized to limit arcing across breaker 14. Such arcing would burn the points and soon destroy them. The Kettering system described above has been used since the beginning of this century. This system has generally performed adequately until the last few years. Increasing concern with air pollution and recent increases in fuel prices have justified alternatives to the basic Kettering system.

Figure 2:
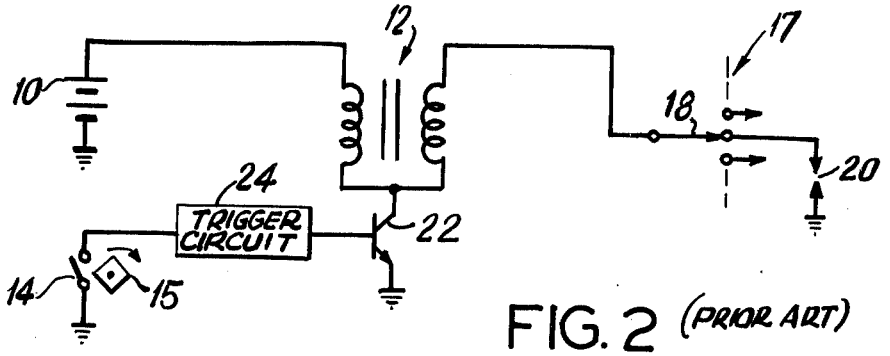
FIG. 2 (PRIOR ART)

FIG. 2 illustrates a variation of the Kettering Ignition System, generally known as a transistor ignition system, which has been used since 1974 on many production automobiles in the United States. Current flows from battery 10 through the primary of coil 12 and back to the battery through transistor 22. Transistor 22 serves the same function with regard to the coil primary as did the breaker points in the Kettering system. This system does not need capacitor 16, because the transistor is capable of switching off the primary current much more rapidly than the breaker points and therefore there is no arcing problem. Timing information is provided by cam 15 and breaker points 14 in the same manner as described above for the Kettering system, or by other per se well known timing elements (e.g., of optical or magnetic construction). This timing information is applied to trigger circuit 24 which discriminates between firing signals and spurious noise and provides adequate drive to transistor 22. Transistor 22 is turned on each time the breaker points close and turn off each time the breaker points open. This causes a build up and collapse of a magnetic field in the primary of the coil which in turn induces the high voltage in the secondary of coil 12 necessary to drive the spark plugs. The high secondary voltage is then distributed to spark plugs 20 in the same manner as was done in the Kettering system.

Figure 3:
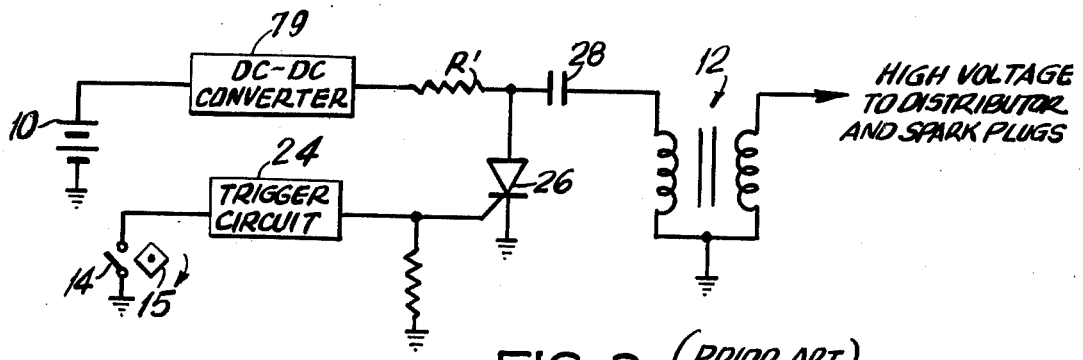
FIG. 3 (PRIOR ART)

Referring now to FIG. 3, there is shown a capacitor discharge ignition system which is another example of prior art ignition systems. In this system instead of storing energy in the magnetic field in the coil 12, ignition spark energy is stored in capacitor 28. Capacitor 28 is charged to a high voltage (e.g., about 300 volts) by a DC-to-DC converter 79 in conjunction with battery 10. Engine timing information is again provided as by points 14 and cam 15. This timing information is applied to trigger circuit 24, which is utilized to drive an SCR 26. When a signal is received from the timing apparatus indicating that a spark is desired the SCR is turned on and connects one end of capacitor 28 to ground. The other end of capacitor 28 is connected to primary of the coil 12. The discharge of capacitor 28 through SCR 26 causes the build up of a magnetic field in the primary of coil 12. This in turn induces a high voltage in the secondary of coil 12 which is distributed by the distributor to the spark plugs in the same manner as indicated above.

Each of these prior art systems produce one and only one spark for each opening of the breaker points. With such an arrangement it is imperative that this single spark occur when the combination of fuel and air in the combustion chamber be of exactly the right mixture to ensure proper ignition and complete burning of the mixture. Incomplete burning or lack of ignition reduces engine performance, increases gas consumption and adds to the air pollution problem.

It has been found that the problem of incomplete burning or non-ignition can be overcome by a system which utilizes a series of closely spaced spark pulses to ignite the charge in the cylinder. Much time and effort has been expended in the prior art to produce a timing system which produces a spark at the proper time for optimum burning. Rather than concentrating on producing a single spart at the optimum time, the instant invention is concerned with producing a number of sparks closely spaced in time, with the first spark occuring at or near the optimum time. Therefore, with the instant invention the first of a series of multiple sparks will be delivered at the predicted time for best combustion. If it occurs when the combustion mixture is normal the mixture will properly ignite and the remainder of the sparks will have little or no value; but they will also cause no difficulties. If, however, the first spark occurs in an increment of mixture volume which is too lean or too rich the burning will not take place or it may propagate slowly, and the burning will not be completed in the available time. In this instance there is a real possibility that a second or subsequent attempt to ignite the mixture can speed matters up and produce a more normal, uniformed, and complete burn. The remainder of this description is directed to such a multiple sparking ignition system.

Figure 4:
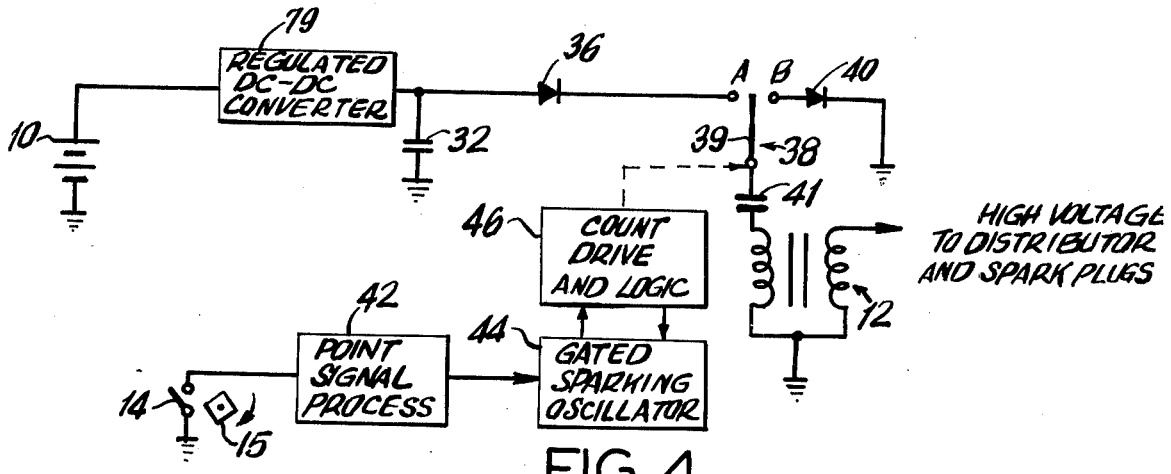
FIG. 4 discloses a block diagram of an improved multiple sparking ignition system.

Referring to FIG. 4, there is shown a schematic block diagram of a first proposed multiple spark ignition system. Capacitor 41 in the primary circuit of coil 12 performs an analogous function to that described above for the capacitor 28 in the capacitive discharge system (FIG. 3). In this case, however, switch 38 rapidly moves back and forth between points A and B to produce multiple sparks as will be hereinafter described. Power from battery 10 is applied to the regulated DC-DC converter 79. Converter 79 functions to raise the available battery voltage from the initially available 7 to 15 volts to about 200 volts.

Energy from the DC-to-DC converter 79 is stored in capacitor 32. When switch 38 is in position A, charge from energy storage capacitor 32 flows through diode 36, and switch 38 transfer contact 39, to charge capacitor 41 through the primary of coil 12. Storage capacitor 32 is advantageously much larger than capacitor 41, therefore the voltage across capacitor 32 changes very little when capacitor 41 is being charged. The current flowing to the primary of coil 12 while capacitor 41 is being resonant charged in this first polarity produces the first spark which is distributed to the spark plugs in the manner previously described. As is well known per se for resonant charging, diode 36 terminates current flow with a voltage stored in capacitor 41 is double that across source capacitor 32, less energy delivered to the fired cylinder.

Switch 38 is next thrown to position B. An opposite resonant charging, half cycle obtains, such that the voltage across capacitor 41 reverses polarity. Resonant charging ends when the diode 40 blocks the attempted current reversal. Again, the rapid current flow through the primary of the coil 12 generates a cylinder firing spark. Therefore, this FIG. 4 system produces one spark when capacitor 41 is charged in a first polarity (Switch 38 in position "A"), and produces a second spark when the voltage across capacitor 41 reverses (Switch 38 in the "B" position). This in marked contrast to the systems described above which produced only one spark by discharging the series capacitor 28 (FIG. 3).

The action of switch 38 is under the control of engine timing elements, e.g., the engine cam 15 and points 14 (although, as before, any per se well known timing structure coupled to the drive shaft may be employed). Processing circuitry 42 produces a square wave output pulse for a timed interval after the points 14 open. In accordance with an optional aspect of the present invention, the output of processing circuit 42 changes back to its initial state after a timed interval which is dependent upon engine speed. The length of the output pulse from circuit 42 will determine the number of sparks that will be produced for each opening of the points.

The output of processing circuit 42 is used to drive gated "sparking" oscillator 44. This oscillator sets the time spacing between subsequent sparks. Counter and drive logic 46 counts cycles of this oscillator and in turn is utilized to drive switch 38. In accordance with one optional aspect of the invention, counter 46 is utilized to assure that an even number of sparks are provided for each point opening of the engine, and thus that spark plug firing current polarity is of a like state. In practical spark plugs the sparking voltage is found to be lower when the hotter central electrode of the plug is negative with respect to ground. Circuitry 46 ensures that the first spark of each group of sparks will have this negative polarity. Second and subsequent sparks of a series of sparks are easier to produce than the first because there are a large number of ions in the vicinity of the spark gap just after the first spark. By counting the sparks produced for each point opening and making this an even number it is assured that the first spark produced is of the negative or preferred polarity.

In summary then, it can be seen that the circuitry in FIG. 4 produces plural sparks each time points 14 open. The number of sparks produced for each such opening is dependent on the frequency of oscillator 44. The higher the frequency of the oscillator 44, the greater the number of sparks produced for each opening of the points. Producing multiple sparks for each point opening gives rise to complete and total combustion for each chamber in the automobile engine.

Figure 5:
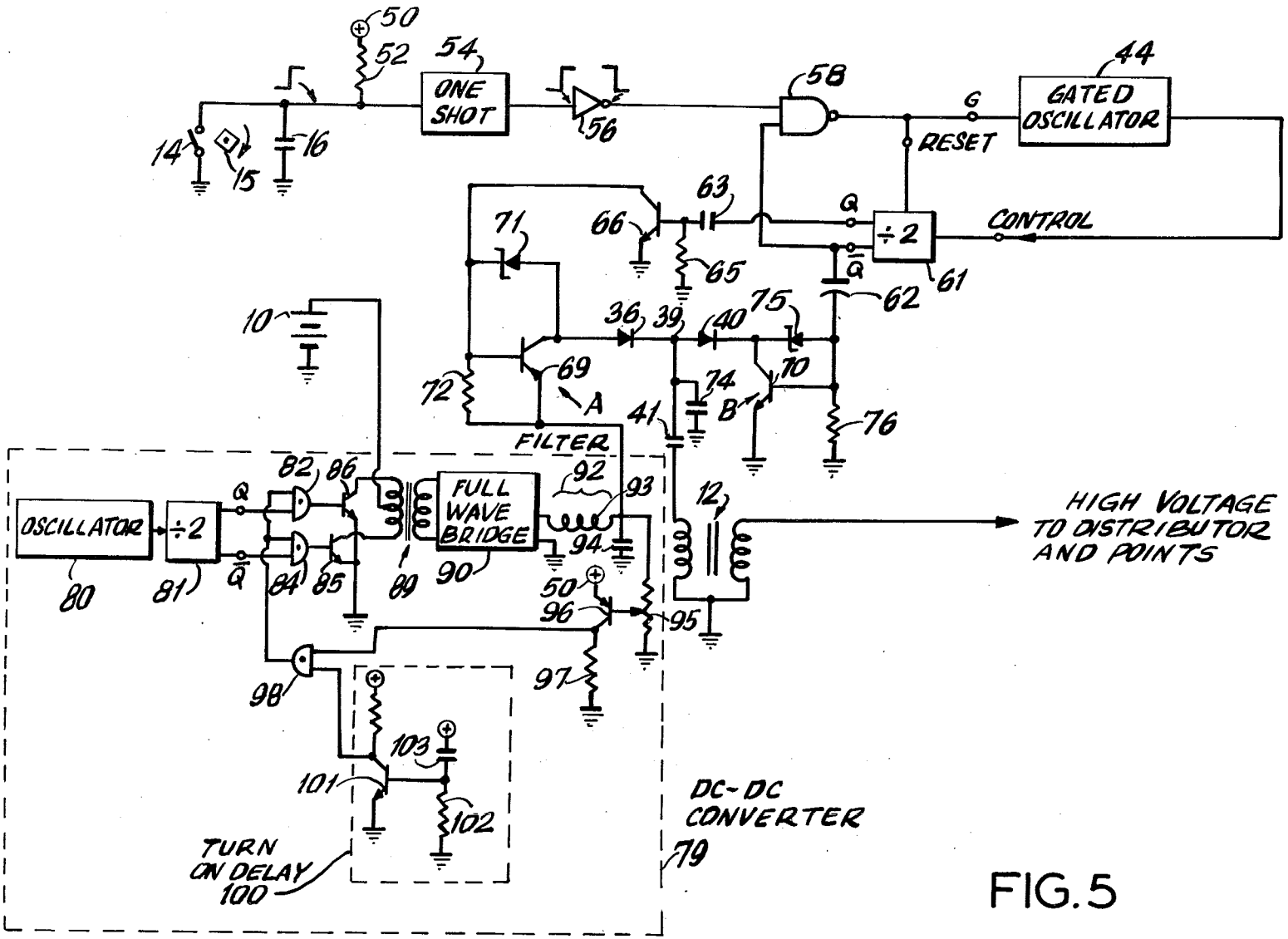
FIG. 5 discloses a schematic drawing for one embodiment of an improved multiple sparking ignition system.

Referring now to FIG. 5, there is shown a schematic diagram of a multiple spark ignition system of the type described in block diagram form in FIG. 4. Power from battery 10 is applied to the DC-DC converter 79. The power is applied to the center tap of coil 89 and from there to push-pull arranged transistors 85 and 86. Drive for transistors 85 and 86 is supplied from oscillator 80 which operates at approximately 10KC. Its output is applied to a counter (e.g., a toggle flip-flop) 81 which divides the output frequency in half. The output of flip-flop 81 comprises two square waves which are 180 degrees out of phase. These two drive signals are applied to one input of AND (coincidence) gates 82 and 84. Gates 82 and 84 in turn are controlled by turn on delay circuit 100 and a voltage regulator error sensing circuit consisting of transistor 96 and associated circuitry.

Turn on delay circuit 100 is utilized to prevent the firing of a cylinder when the engine is first switched on, but before the activation of the engine starter motor. When power is first applied to delay circuit 100 transistor 101 is biased on through capacitor 103 which begins to charge. Under this condition a relatively low level (logical zero for conventional current sinking logic) is applied to one input of AND gate 98. Therefore, the output of gate 98 is also a logical zero which ensures that gates 82 and 84 are turned off and there is no drive applied to transistors 85 and 86.

When capacitor 103 has charged through resistor 102 and the base-emitter junction of transistor 101, transistor 101 stops conducting and applies a relatively high level (logical one) to the input of gate 98. Assuming a logical one being applied to the remaining input of gate 98 by the regulator circuitry signalling that output energy is required, gate 98 switches to a high output state, thus partially enabling the AND gates 82 and 84. These gates 82 and 84 alternately turn on when the Q, Q outputs of flip-flops 81 are high to apply push-pull drive signals to the inputs of transistors 85 and 86. The high voltage secondary of chopper transformer 89 thus provides AC drive to full wave rectifier bridge 90. This bridge rectifies the output of transformer 89 and applies a DC output to a low pass ripple filter 92, e.g., formed of a series inductor 93 and shunt capacitor 94.

When filter output capacitor 94 has been charged to the intended output value (as adjusted and selected by potentiometer 95) transistor 96 turns off by per se conventional regulator action. This puts a low level logical zero on one input of gate 98 thereby disabling this gate. Gate 98, in turn, disables gates 82 and 84 thereby removing the drive from transistors 85 and 86. Therefore, when the desired output voltage is exceeded, drive is removed from transistors 85 and 86, terminating the DC-to-DC conversion action. However, energy is still stored in inductor 93 and capacitor 94. When the energy stored in capacitors 94 decreases in value, transistor 96 will again be turned on enabling gate 98 which in turn reapplies alternating drive to transistors 85 and 86 through gates 82 and 84. As per se well known, hysteresis may be employed in the voltage level sensor/comparator to define a range of output potential across capacitor 94.

The charge stored in capacitor 94 is utilized to resonant charge capacitor 41 in a first polarity through diode 36 and transistor 69 (which performs the function of switch "A" in FIG. 4) and the coil 12 as above-discussed. The charge stored in capacitor 41 is in turn reversed via diode 40 and transistor 70 (serving as switch "B" in the FIG. 4 schematic presentation) and the coil 12. The resonant charging of capacitor 41 through the primary of coil 12 generates multiple sparking in the manner described above.

The signals for turning transistors 69 and 70 on and off originate in points 14 and cam 15 (or other timing elements alternatively employed) as previously described. When the points open, a positive going signal is applied to the input of one shot multivibrator 54. The duration of the output pulse from multivibrator 54 is substantially fixed at low engine speeds (low repetition rates) and is determined by internal reactive timing components at faster rates as is per se understood in the art. By proper selection of the internal timing components in multivibator 54, its output can be arranged to give an output pulse of approximately 10 milliseconds in duration for a triggering rate of 33 pulses per second, and can give an output pulse of 1 millisecond duration for a triggering rate of 330 pulses per second. These rates are appropriate for 500 and 5,000 rpm for an 8 cylinder engine.

The output of multivibrator 54 is inverted by inverter 56 and applied to one input of NAND (coincident) gate 58. The remaining input of gate 58 is normally high as counter (e.g., a toggle flip flop) 61 is normally in a reset state. Therefore, the output of gate 58 goes high which enables oscillator 44. Oscillator 44 operates at approximately 2,000 hertz, supplying its output to flip flop 61 which produces when active two output square waves 180 degrees out of phase. Flip flop 61 begins in a quiescent state. Therefore, the first time this flip flop is triggered, the Q output of the flip flop goes high. This positive going pulse is applied to the base of transistor 66 turning this transistor on, thus also enabling the "A" switch transistor 69. The activated transistor 69 passes current from capacitor 94 through diode 36 to the capacitor 41 and coil 12 as previously described. This action produces the first spark of the multiple sparking arrangement. Approximately 500 microseconds later, the Q output of flip flop 61 goes low and Q output of flip flop 61 goes high, directly turning on the "B" switch transistor 70 and turning off switch 69. The transistor 70 and diode 40 provide a path to reverse resonant charge capacitor 41, thereby producing the second spark in the manner previously described.

The process described above continues as long as the output of monostable multivibrator 54 is high. During this time, oscillator 44 continues to run and its output is divided by flip flop 61. This provides alternating drive pulses to transistors 69 and 70 in the manner described above. Therefore, as long as the output of multivibrator 54 is high, multiple sparking pulses are continuously applied to the spark plugs.

When the output of multivibrator 54 goes low signalling the end of the sparking period, a high level ("on") is applied to the upper input of gate 58 via inverter 56. When the Q output of flip flop 61 again returns high (if it is not already in this state), a second high is applied to the input of gate 58. Therefore, the output of NAND gate 58 goes low turning off oscillator 44 and resetting flip flop 61 to the reset state. Thus, the circuitry always resides in the same state when the points close such that, upon point reopening, the first spark is always of the same polarity.

Protection in the FIG. 5 circuitry arrangement is provided by zener diodes 71 and 75. These two diodes limit the voltage which can appear across the base-collector junction of transistors 69 and 70 under adverse conditions such as an open spark plug lead. This would cause high voltages to be reflected back through the ignition coil which could damage transistors 69 and 70. Capacitor 74 is a small capacitor merely used as a radio frequency bypass for the output line. This completes the description of the multiple sparking arrangement shown in FIG. 5.

Figure 6:
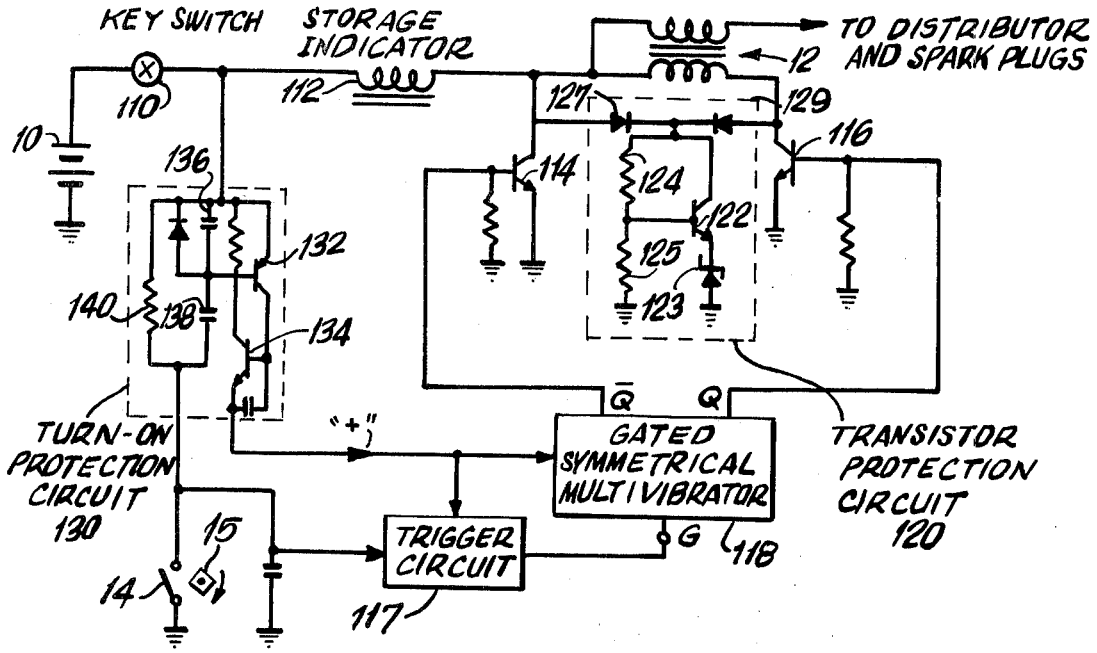
FIG. 6 discloses a schematic drawing of a multiple sparking ignition system utilizing an inductor as an energy storage device.

Referring to FIG. 6, there is shown a second embodiment of a multiple spark automotive ignition system. The system shown in FIG. 6 utilizes an inductor to store the sparking energy rather than a capacitor as was described above. A multiple spark ignition system is limited by the rapidity with which it can produce sparks. This limitation is in turn determined by the time it takes to store energy in the spark coil. The time it takes to store energy in the sparking coil can be shortened if the charging voltage is substantially higher than the battery voltage normally used to charge the coil. This is the original reason why a capacitor discharge system is used. However, when a charged capacitor is connected across the coil primary, a spark is produced but the coil primary does not end up with any stored energy after the capacitor is discharged. Therefore, an advantageous method is to store energy in the coil primary by connecting it to a constant current source which already contains energy.

FIG. 6 utilizes coil 12 in the same manner as described above. Transistors 114 and 116 provide the multiple sparking as will be hereinafter described. The system in FIG. 6, however, contains storage inductor 112 which functions as a constant current source connected in series with the primary winding of coil 12. Assume now that transistor 116 is biased in the "on" condition. In this stage, current flows from the battery 10, through the key switch 110, through storage inductor 112 and through the primary of coil 12. In both inductors, there is stored energy equal to $\frac{1}{2}$ $L1^2$, where L is the inductance in henrys of the particular coil and I is the current in amperes. The spark coil will typically have a primary inductance of about 5 millihenrys. The storage inductor can easily be made 20 times as large and it will therefore store 20 times as much energy.

When a series of sparks are desired to fire a particular cylinder, it is necessary to switch the primary of coil 12 from being in series with the storage inductor 112 to engine ground potential. Therefore, when transistor 114 is turned on and transistor 116 turned off, the primary of coil 12 is connected to ground collapsing the magnetic field previously built up in this coil. This produces spark voltage in the secondary of coil 12 in the manner previously described. When transistor 114 is turned off and transistor 116 again turned on, the path between battery 10 to ground through the storage inductor and the primary of the coil 12 is restored. Therefore, the current flowing through the primary suddenly increases, inducing a magnetic field into the secondary of coil 12 which produces a second spark. This sparking sequencecontinues as long as the multivibrator 118 remains gated on by the trigger circuit 117.

The drive for switching transistor 114 and 116 is provided by gated, symmetrical output multivibrator 118 which is driven by trigger circuit 117. The trigger circuit receives timing information from points 14 and cam 15 in the same manner as the previous systems received their timing information. Trigger circuit 117 detects the opening and closing of points 14 and each time points 14 open, trigger circuit 117 enables astable multivibrator 118. This multivibrator in turn provides two 180° out of phase square wave pulse trains to switching transistors 114 and 116. The pulse trains applied to these transistors alternately turn them on and off. This generate multiple sparking in the manner described above. The frequency of multivibrator 118 may approximate 2.5 kilocycles to generate one spark approximately every 200 microseconds. At 5,000 rpm, therefore, an 8 cylinder engine will get 5 sparks for each opening of the points. At 400 rpm, there will be over 60 sparks for each opening of the points.

Turn-on protection circuit 130 is utilized to ensure that no sparks will be produced until the points have closed one time. Transistors 132 and 134 in combination form an equivalent SCR as is per se well known. This equivalent SCR is enabled by the negative going voltage transition generated by the first closing of points 14. Once transistors 132 and 134 are enabled, battery voltage is applied to circuits 117 and 118 to thereafter enable these elements.

Transistor protection circuit 120 is utilized as a clamp to suppress any high voltage spikes that might otherwise appear at the collectors of transistors 114 and 116 during current switching. When such a spike occurs, transistors 122 is turned on, thus clamping the maximum voltage allowed across either transistor 114 or 116 to the value of zener diode 123, multiplied by the voltage division factor of the resistive voltage divider network formed of resistors 124 and 125, i.e., at level $V_Z \cdot (R124-R125)/R125$). This permits use of common and inexpensive low voltage zener diodes to provide a clamp or reference of hundreds of volts. This completes the description of the inductive multiple spark ignition system shown in FIG. 6.

Figure 7:
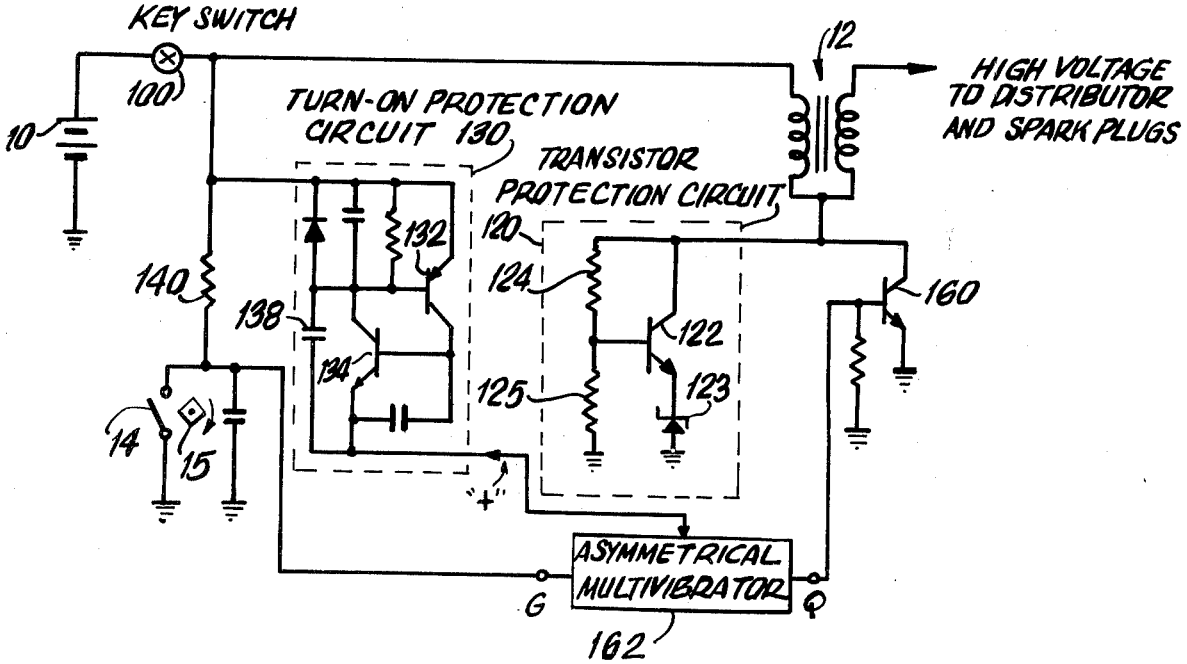
FIG. 7 discloses a schematic drawing of a simplified multiple sparking ignition system.

Referring to FIG. 7, therein is shown a third embodiment of the invention. Turn-on protection circuit 130 is identical to the circuit previously described with reference to FIG. 6. Also, transistor protection circuit 120 functions in the same manner as in FIG. 6. The circuit of FIG. 7 utilizes transistor 160 as the switching transistor. This transistor is driven by an asymmetrical gated free running multivibrator 162. The asymmetrical multivibrator is enabled by turn-on protection circuit 130 after an initial delay in the same manner as described above. When points 14 are closed, the output of multivibrator 162 is high which holds transistor 160 in the on state. When points 14 are open, the multivibrator oscillates in such a way that it alternately turns the switching transistor off for unequal periods, e.g., one-half millisecond and then on for 2 milliseconds. The longer on-time is required to store meaningful energy in the core of coil 12.

This oscillation continues as long as the points are open. When the points close again, the transistor 160 is returned to a steady on condition. The result of this oscillation period is the production of a spark each 2.5 milliseconds as long as the points are open. For a four cylinder engine, this provides two sparks per cylinder at very high speeds (e.g., 4,000 rpm) and provides approximately ten sparks per cylinder at low speeds (e.g., 400 rpm). The first spark of the series is the strongest. Later sparks are of course limited by the smaller amount of energy which is stored in the coil during the dwell time. Turning the switching transistor 160 on and off by the multivibrator builds up and collapses the magnetic field in the primary of coil 12 in the manner described above. This in turn is reflected to the secondary of coil 12 which distributes sparks to the various spark plugs.

The above-described arrangements, are merely illustrative of the principles of the present invention. Numerous modifications and adaptations thereof will be readily apparent to those skilled in the art without departing from the spirit and scope of the present invention.

What is claimed is:

1. In combination in an engine ignition system, a coil having primary and secondary windings, a capacitor serially connected to said coil primary winding, first gated means for resonant charging said capacitor in a first polarity through a path including said coil primary winding, second gated means for charging said capacitor in a polarity opposite to said first polarity through a path including said coil primary winding, timing means for alternately enabling said first and second gated means during active engine ignition periods.

2. A combination as in claim 1, wherein said first and second gated means each comprises controlled switch means and a diode serially connected thereto.

3. A combination as in claim 2 further comprising D.C. potential supplying means connected to said first gated means, and cascaded distributor and points connected to said coil secondary winding.

4. An internal combustion automotive engine ignition system comprising engine timing signalling means for selectively signalling that an engine chamber is conditioned for ignition, an ignition coil having a primary and a secondary winding and a voltage source serially connected with said primary winding, said timing signalling means responsive to the rotation of an automobile engine driven cam shaft for signalling the state thereof, characterized in that the ignition system further includes, means responsive to each ignition conditioned signal provided by said timing signalling means for generating two pulse trains characterized by time alternating pulses, first means response to each pulse of said first pulse train for directing current flow through said coil primary winding in a first direction, thereby inducing a first voltage pulse in said coil secondary winding, and second means responsive to each pulse of said second pulse train for directing current flow through said coil primary winding in a second direction, thereby inducing a second voltage pulse in said coil secondary winding.

5. An automotive ignition system in accordance with claim 4, wherein said voltage source includes a DC-to-DC converter and a storage battery for providing power to said DC-to-DC converter, said voltage source further including delay means for normally disabling said DC-to-DC converter for a predetermined period of time.

6. An automotive ignition system in accordance with claim 5, further comprising a storage capacitor serially connected with said coil primary winding.

7. An automotive ignition system in accordance with claim 4, wherein said timing signalling means comprises automotive break points arranged to open and close in response to the rotation of an engine cam shaft.

8. An automotive ignition system in accordance with claim 4, wherein the number of pulses included in said pulse trains generated by said generating means varies in direct relation to the revolutions per minute of the automotive engine.

9. An internal combustion automotive engine ignition system comprising engine timing signalling means for selectively signalling that an engine chamber is conditioned for ignition, an ignition coil having a primary and a secondary winding, a constant current source connected to said coil primary winding, said timing signalling means including means responsive to the rotation of an automobile engine driven cam shaft for signalling the state thereof, means responsive to each ignition conditioned signal provided by said timing signalling means for generating two pulse trains each including plural pulses, the pulses of a first one of said pulse trains alternating with the pulses of the other said pulse trains, and means responsive to each pulse of one of said pulse trains for directing current flow from the current source into said coil primary winding to produce a first voltage pulse in said coil secondary winding and responsive to each pulse of the other of said pulse trains for diverting current flow from the current source away from said coil primary winding, to produce a second voltage pulse in the secondary winding.

10. An automotive ignition system in accordance with claim 9, wherein said constant current source comprises a voltage source connected in series with a storage inductor.

11. An automotive ignition system according to claim 9, wherein said timing signalling means comprises automotive breaker points arranged to open and close in response to the rotation of an engine cam shaft.

12. An automotive ignition system in accordance with claim 11, wherein said timing means further includes means responsive to the opening of the breaker points for producing an enabling signal during the interval said breaker points are open and a disabling signal during the interval the breaker points are closed.

13. An automotive ignition system in accordance with claim 12, wherein said generating means further includes oscillating means responsive to said enabling signal produced by said timing means for generating the two pulse trains and responsive to said disabling signal for terminating said pulse train generation.

14. An automotive ignition system in accordance with claim 13, further including circuit protection means for normally preventing operation of said generating means and for permitting operation of the generating means subsequent to the occurrence of a first opening of the breaker points.

15. An automotive ignition system in accordance with claim 9, wherein said directing and diverting means includes a first transistor for completing a current path between said current source and said coil primary winding and a second transistor for shunting the current supplied said current source away from said coil primary winding.

16. An automotive ignition system in accordance with claim 15, further including protection means connected to the collectors of the first and second transistors, the protection means being responsive to the occurrence of an overvoltage of the collectors of said first and second transistors for limiting clamping the voltages to a predetermined maximum voltage value.

* * * * *